US007520208B2

(12) United States Patent
Beuth et al.

(10) Patent No.: US 7,520,208 B2
(45) Date of Patent: Apr. 21, 2009

(54) DRIVE DEVICE COMPRISING A POSITION CONTROLLER

(75) Inventors: Bernd Beuth, Ebersbach (DE); Uwe Mödinger, Wernau (DE)

(73) Assignee: Festo AG & Co. KG, Esslingen (DE)

( * ) Notice: Subject to any disclaimer, the term of this patent is extended or adjusted under 35 U.S.C. 154(b) by 235 days.

(21) Appl. No.: 11/662,510

(22) PCT Filed: Feb. 21, 2006

(86) PCT No.: PCT/EP2006/001532

§ 371 (c)(1),
(2), (4) Date: Mar. 9, 2007

(87) PCT Pub. No.: WO2006/114147

PCT Pub. Date: Nov. 2, 2006

(65) Prior Publication Data

US 2008/0060509 A1 Mar. 13, 2008

(30) Foreign Application Priority Data

Apr. 22, 2005 (DE) ..... 20 2005 006 795 U

(51) Int. Cl.
*F15B 9/09* (2006.01)
*F01B 31/12* (2006.01)

(52) U.S. Cl. ..... 91/363 R; 91/1; 92/5 R

(58) Field of Classification Search ..... 91/1, 91/361, 363 R, 403; 92/5 R, 169.1
See application file for complete search history.

(56) References Cited

U.S. PATENT DOCUMENTS

| | | | | |
|---|---|---|---|---|
| 3,828,556 | A * | 8/1974 | Nolden | 60/432 |
| 4,099,450 | A | 7/1978 | Mase | |
| 6,530,220 | B2 * | 3/2003 | Porter et al. | 60/478 |
| 6,755,115 | B2 * | 6/2004 | Stoll et al. | 91/363 R |
| 2003/0029309 | A1 | 2/2003 | Beuth et al. | |

FOREIGN PATENT DOCUMENTS

| | | | |
|---|---|---|---|
| DE | 3524414 | A1 | 10/1986 |
| DE | 199 37 597 | A1 | 2/2001 |
| DE | 100 21 744 | A1 | 11/2001 |

* cited by examiner

*Primary Examiner*—Michael Leslie
(74) *Attorney, Agent, or Firm*—Hoffmann & Baron, LLP

(57) ABSTRACT

A drive device comprises a fluid driven drive (2), which defines a drive space (8), in which at least one drive piston (14) is located which is able to be linearly shifted by fluid actuation and is kinematically coupled with an output drive part (17). Furthermore there is a position regulator (3) which is responsible for setting the position of the at least one drive piston (14), such regulator having a electronic regulation circuitry (26) and a valve means (27) and being a component of a regulator cartridge (28) which is inserted as a unitary assembly from the side, which is axially opposite to the drive space (8), through an installation opening into a accommodating space (25) defined by an integral extension of the drive housing (4) made in one piece therewith and axially in sequence with the drive space (8).

24 Claims, 2 Drawing Sheets

DRIVE DEVICE COMPRISING A POSITION CONTROLLER

FIELD OF THE INVENTION

The present invention relates to a drive device which possesses a fluid operated drive and furthermore a position regulator rendering possible positioning of the output drive part with electronic regulation circuitry and a valve means

BACKGROUND OF THE INVENTION

In such a known drive device in accordance with the German patent publication 199 37 597 A1 a regulator and a positioning drive are accommodated in a common housing. The housing also contains a regulating valve able to be controlled by the electronic regulator, by way of which the action of fluid in two cylinder chambers of the fluid power drive is controlled. The integration of the fluid power drive and of the positioning drive in a common housing more particularly serves the purpose being able to avoid having a mechanical coupling point and the concomitant lack of accuracy in positioning.

While the above mentioned German patent publication 199 37 597 A1 achieves integration, this is rather more an abstract concept than the disclosure of specific designs.

Departing from the above described position-regulated drive device the German patent publication 100 21 744 A1 describes a drive device with a position regulator predominantly based on pressure regulation. The individual regulation components are in this case constituted separately by the fluid power drive or mounted thereon.

SUMMARY OF THE INVENTION

One object of the present invention is to devise a drive device with a position regulator which exhibits compact dimensions and is readily mounted in position.

This aim is to be achieved by drive device comprising a fluid operated drive, which possesses a drive housing defining a drive space, in which at least one drive piston is located, said piston being able to be linearly set by fluid action and being kinematically coupled with an output drive part, a position regulator responsible for the positioning of the at least one drive piston and possessing electronic regulation circuitry and a valve means, such position regulator being a component of a regulator cartridge, which is inserted as a unitary assembly from the side, which is axially opposite the drive space, through an installation opening into an accommodating space defined by an integral one-piece-made extension of the drive housing axially adjoining the drive space.

In the case of this drive device the position regulator is directly placed in the housing of the fluid power drive. Installation is extremely simple, because the position regulator belongs to a unitary assembly termed the regulator cartridge, which is inserted like a cartridge into an accommodating space provided therefor in an axial extension of the drive space. Separate installation and attachment measures are unnecessary for the individual components of the position regulator, since same may be premounted within the regulator cartridge so that installation on site on the drive is reduced to a few simple manual operations. The term "drive piston" is to be understood also to mean a drive diaphragm or membrane.

Advantageous further developments of the invention will appear in the dependent claims.

The drive space and the accommodating space are preferably located in axial succession in the internal space of an integral one-piece-made tubular body of the drive housing. Such a tubular body may be manufactured economically as a rule by extrusion. A tubular body of a suitable length is all that is required in order to simultaneously define the drive space and the directly adjacent accommodating space.

In principle it would be possible to have the division between the drive space and the accommodating space within the drive housing in the form of a separate partition. Nevertheless a substantially more advantageous design is one in which the regulator inserted cartridge itself constitutes a terminal wall delimiting the drive space in a fluid-tight manner and separating it from the accommodating space. The installation of the regulator cartridge accordingly not only involves insertion of the position regulator but also simultaneously the preferred separation from the drive space which during operation is subject to fluid pressure.

The terminal wall may more particularly be a disk body designed as a component of the regulator cartridge and which peripherally is provided with a seal making sealing contact with the bore face of the internal space in the drive housing.

It is furthermore an advantage for the regulator cartridge inserted into the drive housing to simultaneously constitute a closure cover shutting off the installation opening. This means that it is possible to do without any otherwise necessary separate closure cover. Given a suitable configuration the closure cover together with the drive housing may set the depth of insertion of the regulator cartridge. This is in particular an advantage if the regulator cartridge is in the form of a plug part able to be put in place by a simple insertion operation into the accommodating space.

The terminal wall and the closure cover are preferably joined together by way of one or more distance pieces to form a support structure bearing the electronic regulation circuitry and the valve means. For instance several mutually spaced apart rod-like distance pieces may be provided which at one end are secured to the terminal wall and at the other end are secured to the closure cover. The electronic regulation circuitry and the valve means are preferably located in the intermediate space between the terminal wall and the closure cover.

All the fluid and the electrical interfaces necessary for the fluid and electrical communication with external means are preferably provided in the regulator cartridge so that on the drive housing it is unnecessary to take any corresponding measure. This renders possible very simple manufacture of the drive housing. The electrical control from the outside may be both by means of cables and also in a wireless manner.

Preferably the interfaces are arranged on or in the closure cover that is to say in particular so that they are accessible from the outer side, axially opposite to the drive space, of the closure cover.

The electrical interfaces will preferably include a power supply interface, to which the power supply, necessary for the operation of the position regulator, can be applied. Furthermore at least one control interface will be present, which in particular serves to feed control signals corresponding to the desired target position by the application of a control current of a greater or lesser size. At least one control interface can also be designed in the form of a bus interface rendering possible communication with an external electronic control means, the position regulator being able to be designed accordingly in order to render possible control with the use of different bus protocols.

Preferably the closure cover is provided with manually operated control element and/or with optical display means. The control elements renders possible, for instance, manual activation in the case of the application specific means of the drive device or for servicing purposes. Furthermore with the aid of the control elements condition relevant data may be retrieved which may then be seen on the display means.

The control element and/or the display means are preferably placed in circuit with auxiliary electronic circuitry present in addition to the electronic regulation circuitry, such auxiliary circuitry being best accommodated in the interior of closure cover and possibly mounted on a circuit board. This auxiliary electronic circuitry may comprise, in connection with a suitably designed control interface, electronic bus circuitry adapted to the respective protocol to be implemented.

In order to implement position dependent regulation of the drive piston with a high degree of precision a suitable electronic position finding means for the drive piston position (which may be termed the piston position for simplicity) or a component kinematically coupled with the piston is present, which is suitable for detecting. Same may comprise a measuring component extending into the drive space and preferably in the form of a rod, which is a component of the regulator cartridge and in the case of which during installation of the regulator cartridge is automatically placed in the correct position in the drive space. Preferably the measuring component extends to a greater or less extent into the drive piston in a way dependent on the current axial position of the associated drive piston and into any piston functioning as an output drive part possibly connected with same.

The drive device may be designed for producing either a linear or a rotary output drive movement of the output drive part. The fluid operated power drive is then either a linear drive or a rotary drive, and in the case of the rotary drive the linear movement of at least one drive piston is converted into a rotary movement of the output drive part.

In the following the invention will be described with reference to the accompanying drawings.

DETAILED DESCRIPTION OF THE PREFERRED EMBODIMENTS

Figure 1:
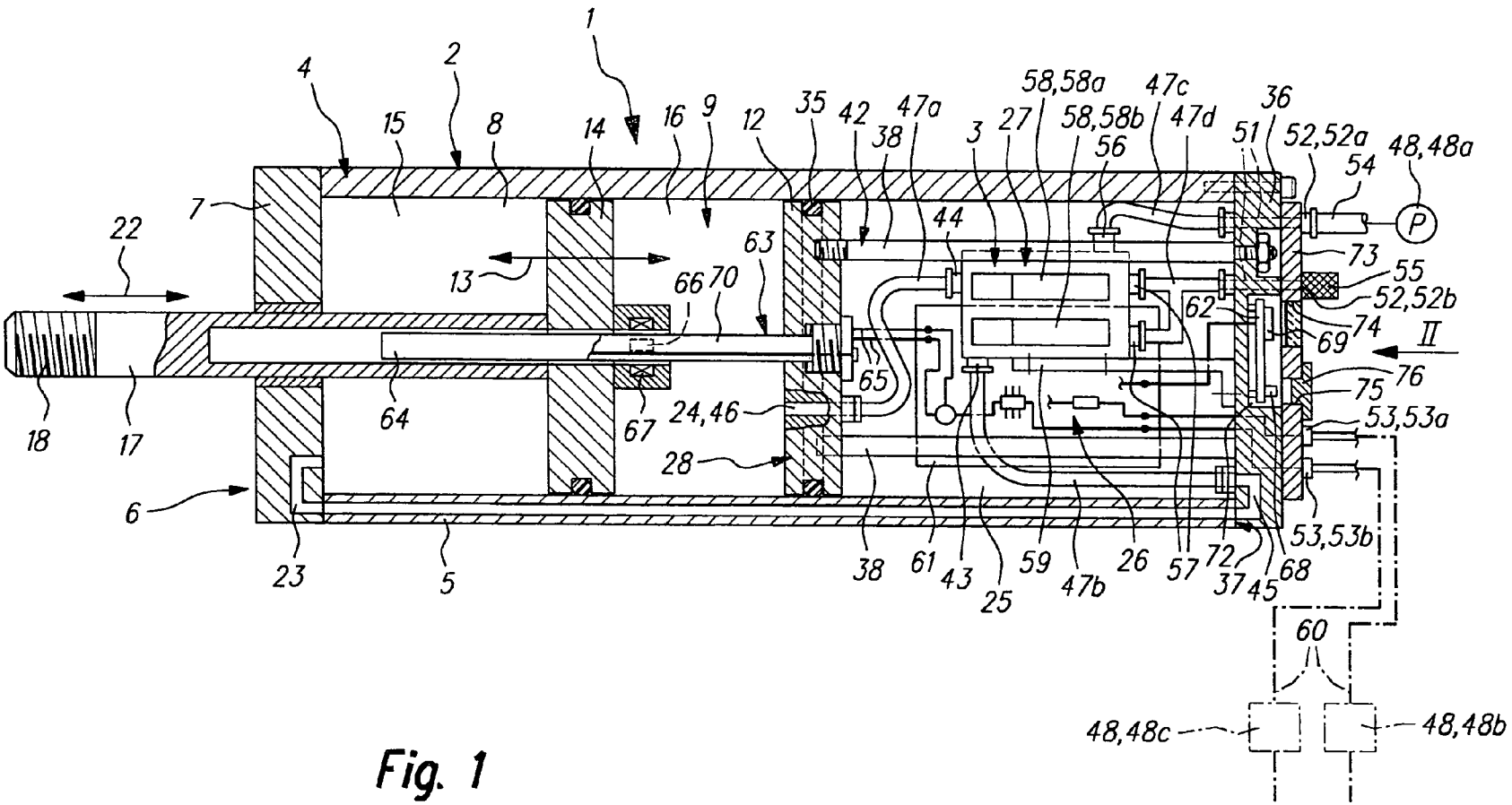
FIG. 1 shows a preferred first working example of the drive device in accordance with the invention in a longitudinal section.
Figure 2:
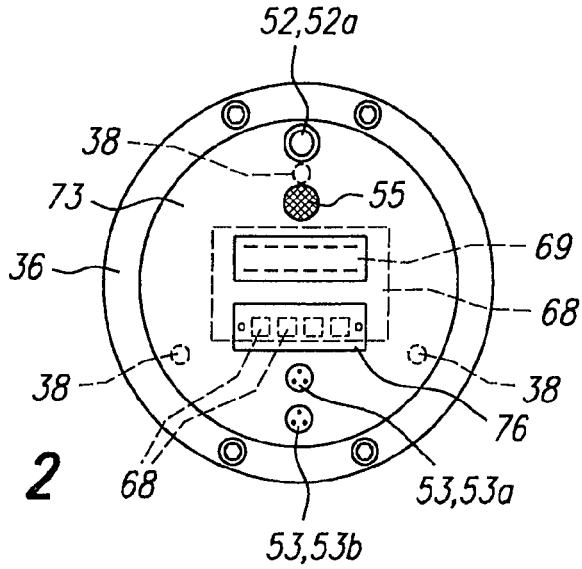
FIG. 2 shows the drive device of FIG. 1 in a rear view looking in the direction of the arrow II in FIG. 1.

The drive device generally referenced 1 comprises as the basis components a fluid power drive 2 and a position regulator 3 associated with it.

The drive 2 possesses a housing termed the drive housing 4 with an elongated housing component, which is in detail constituted by a more particularly integral tube body 5 preferably formed by extrusion. At one end face, which is in the following will be referred to as the front side 6 for clarity, the tubular body 5 is shut off by a bearing end plate 7, which simultaneously constitutes the front axial limit of a drive space 8 formed in the drive housing 4, such drive space 8 being delimited at the rear by a terminal wall 12 inserted into the interior space 9 of the tubular body. Inside the drive space 8 there is a drive piston 14 able to be driven to perform a linear drive movement 13, such piston 14 making sliding sealing contact with the inner face of the tubular body and dividing up the drive space 8 into a front working chamber 15 adjoining the bearing cover 7 and a rear working chamber 16 with the terminal wall 12.

An output drive part 17 kinematically coupled with the drive piston 14 is accessible from outside the drive housing 4 and possesses a mechanical interface 18 for connection with a component to be actuated. as for example a spool of a shut off valve employed in the processing industry. The drive movement 13 of the drive piston 14 causes an output movement 22, available at the interface in order for example to open or close a shut off valve.

In the working embodiment the output drive part 17 is designed in the form of a piston rod extending through the bearing cover in a sealed manner with a linear guiding effect. In accordance with the driving motion 13 it performs a linear output drive movement 22.

Into the first working chamber 15 a first fluid duct 23 opens via the bearing cover 7. In a similar fashion the rear working chamber 16 is connected with a second fluid duct 24 extending through the terminal wall 12. Through these two fluid ducts 23 and 24 a fluid pressure medium may be supplied and removed in a controlled manner in order to shift the drive piston 14 linearly in the one or the other direction or to set it at a particular position.

In the case of a modified design the fluid operated drive 2 is not a linear drive as in the example but a rotary drive. In its drive space 8 there are preferably two drive pistons adapted to move in opposite directions, which have racks meshing with a pinion arranged on a shaft functioning as an output drive part and rotatably supported in the drive housing 4, said shaft extending at a right angle to the drive movement 13. In this case the linear drive movement 13 due to the controlled action of fluid leads to a rotary output drive movement of the output drive part.

All designs are suitable for any desired gaseous or hydraulic medium. However it is preferred to employ compressed air. In the case of power detail 2 it is hence more particularly a question of a pneumatic drive.

The drive housing 4 has its tubular body 5 projecting axially past the terminal wall 12 placed in its interior and adjacent to the drive space 8 axially delimits an accommodating space 25 for the position regulator 3. The interior space 9 of the tubular body 5 preferably has the same cross section from end to end and is only divided up by the inserted terminal wall 12 into the drive space 8 and into the accommodating space 25 arranged coaxially as an extension thereof. For delimiting the accommodating space it is therefore unnecessary to fit any additional housing. The drive housing 4 functions as the housing for the position regulator 3 as well.

Figure 3:
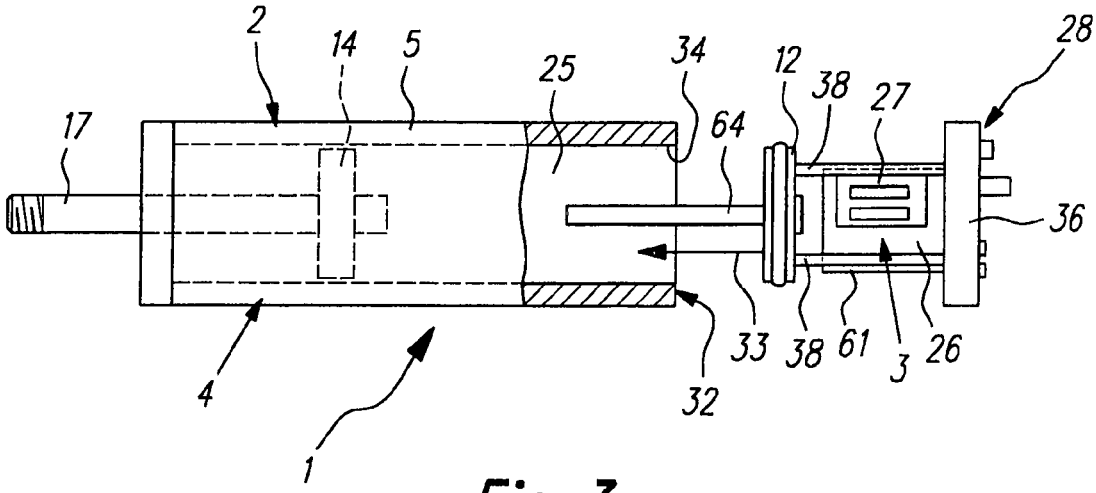
FIG. 3 is a simplified view of the drive device in accordance with FIGS. 1 and 2 with the regulator cartridge removed from the drive housing at the time of insertion into the accommodating space.

The position regulator 3 is characterized in that its various components, in particular its electronic regulation circuitry 26 and its electrically operated valve means 27 are not separately or individually accommodated in the accommodating space 25 but are inserted using a unitary assembly termed a regulator cartridge 28 of which they are components and which is inserted like a cartridge from the rear side 32, opposite to the front side 6, as a self-contained unit in an axial direction into the accommodating space 25. The insertion movement is indicated at 33 in FIG. 3 by an arrow. On insertion the regulator cartridge 28 is inserted through the rear tube opening axially opposite to the bearing cover 7, such opening then functioning as an installation opening 34.

As will be apparent the installation and if necessary deinstallation of the position regulator 3 is very much simplified, because only the regulator cartridge 28 containing all relevant components has to be inserted into or removed from the drive housing. In this respect it is an advantage for the regulator cartridge 28 to be designed as a plug member not entailing rotation parts or screwing them and only an axial shifting movement is necessary for fitting in position and removal. In principle however a combined turning movement would be possible, more especially toward the end of the insertion movement 33.

It is an advantage if, as in the working example, the terminal wall 12 axially delimiting the drive space 8 in the interior of the integral component 5 of the drive housing 4 is a direct component of the regulator cartridge 28. Accordingly separate fitting of the terminal wall 12 is unnecessary. The terminal wall 12 is automatically installed on insertion of the regulator cartridge 28 as well and placed at the desired position in the interior of the drive housing 4.

In order to produce a fluid-tight separation between the drive space 8 and the accommodating space 25 the terminal wall 12 bears a peripherally extending seal 35 at its outer limit, which makes sealing contact with the inner face of the tubular body 5.

The terminal wall 12 is, in the working example, constituted by a disk body, whose periphery corresponds to the cross section of the housing's interior space. The seal 35 may be secured in a peripheral groove in such disk body.

The inserted regulator cartridge 28 preferably also constitutes a closure cover 36 for the installation opening 34. Accordingly the closure cover 36 belongs to the regulator cartridge 28 and is automatically installed on installation or deinstalled on deinstallation thereof and it is unnecessary to have a separate closure cover.

Preferably the closure cover 36 cooperates together with the drive 4 in performing a delimiting function, because it sets the depth of insertion of the regulator cartridge 28. In the working embodiment this is ensured because the closure cover 36 has a larger cross section than the accommodating space 25 so that it abuts the rear end face 37 of the tubular body 5, when the desired depth of insertion is reached. A truing up collar, not illustrated in detail on the axially extending inner face of the closure cover 36 preferably extends somewhat into the accommodating space 25 and in combination with the terminal wall 12 serves to provide an exactly coaxial alignment of the regulator cartridge 28 in relation to the drive housing 4.

The terminal wall 12 and the closure cover 36 are joined together by distance pieces 38, extending axially between them, with the formation of a rigid support structure 42 and are held at an axial distance apart in the circumferential direction. Both the electronic regulation circuitry 26 and also the valve means 27 are seated on this support structure 42, and are both accommodated in the intermediate space between the terminal wall 12 and the closure cover 36.

The distance pieces 38 are preferably rod-like in form and arranged at the same distance apart. In the working embodiment three such distance pieces 38 are provided. In comparison with a single, for example sleeve-like, distance piece this multiple arrangement offers the advantage that intermediate window-like openings, which, when the regulator cartridge 28 is removed permit lateral access to the component of the position regulator 3.

The valve means 27 possesses two power connections 43 and 44, which are connected with one of the fluid ducts 23 and 24. By way of these power connections 43 and 44 the drive fluid is supplied and removed to and from the working chambers 15 and 16. One advantage of the illustrated design is that although the regulator cartridge 28 is a component separate from the drive housing 4, the necessary fluid power connection to the fluid ducts 23 and 24 automatically exists when the regulator cartridge 28 has been inserted into its accommodating space 25.

For this purpose the regulator cartridge 28 comprises a first and a second control duct 45 and 46. The second control duct 46 is identical to the to the above mentioned second fluid duct 24. It extends through the terminal wall 12 and opens directly into the adjoining rear working chamber 16. By way of a preferably flexible fluid duct 47*a* it is joined with the one working connection 44.

The second control duct 46 extends through the closure cover 36. It is at one end joined by way of a fluid duct 47*b* with the other working connection 43. At the other end this first control duct 45 so opens at the cover face facing the end face 37 that it is in line with the first fluid duct 23 opening here, such duct extending through the wall of the tubular body 5 axially and opening by way of the bearing cover 7 into the front working chamber 15.

On insertion of the regulator cartridge 28 into the accommodating space 25 a fluid connection is automatically produced between the first control duct 45 and the first fluid duct 23. Sealing means, which are not illustrated in detail, between the closure cover 36 and the tubular body 5 ensure that there is then a leak-free transfer of fluid. Since the second control duct 46 opens directly into the rear working chamber 16, no sealing means are necessary there.

Since preferably all fluid and electrical interfaces 52 and 53 provided for the communication with external means 48 are arranged on the regulator cartridge 28 there is generally no need for special measures for handling to produce or disconnect fluid and/or electrical connections between the regulator cartridge 28 and the drive housing 4.

The above mentioned fluid and electrical interfaces 52 and 53 are preferably arranged on or in the closure cover 36. In this case they are preferably placed on the end face, axially opposite to the drive space 8, of the closure cover 36 and are accordingly readily accessible from the rear side of the drive device 1.

The fluid interfaces 52 comprise a supply interface 52*a* and a fluid removal interface 52*b*. At the supply interface 52*a* a fluid connection leading to a delay source 48*a* may be produced by way of a detachable internal fluid duct 54, such source supplying the power medium.

By way of the medium removal interface 52*b* spent working medium may be let off. If it is a question of compressed air then at the removal interface 52*b* as illustrated a muffler 55 may be installed, which permits quite venting into the immediate surroundings. Otherwise it is also possible for a fluid duct for the spent medium to be connected to the removal venting interface 52*b*.

The fluid interfaces 52 communicate with ducts 51 extending through the closure cover 36, such ducts opening at the inner face, facing the terminal wall 12, of the closure cover 36, where further fluid ducts 47*c* and 47*d* are connected, which lead to a supply connection 56 and one or more discharge or venting connections 57 of the valve means 27.

The internal fluid ducts 47*a* through 47*d* are in the working example in the form of flexible lines. It may however just as well be a question of rigid lines or of ducts integrated in a suitable fashion in the regulator cartridge 28.

The valve means 27 includes one or more electrically actuated control valves 58. They are in a position of causing, in accordance with their state of activation, such a valve operation that the working chambers 15 and 16 are, for the purpose of positioning the drive piston 14, subjected to the action of fluid or relieved or, respectively, vented. In the working embodiment the control is undertaken by a single control valve 58*a* in the form of a 5/3 way valve, whereas a further control valve 58*b* functions merely as a safety valve, which in the case of electrical power failure assumes a preferred switching position, which results in a shifting of the drive piston 14 and of the output drive 17 into a position which is unobjectionable as regards safety considerations.

The operation of the valve means 27 is performed by the electronic regulation circuitry 28 integrated in the regulator cartridge 28. This circuitry is preferentially mounted on one or more boards 61. In the working embodiment at least one board 61 is secured on the valve means 27, such valve means for its part being held by means of at least one attachment element 59 as indicated in broken lines axially inward on the closure cover 36.

The operating power or voltage necessary for the operation of the valve means 27 is supplied by way of one of the electrical interfaces 53, same operating as the electrical power supply interface 53*a*. In most cases this supply will be at 24 volts. At least one additional electrical control interface 53*b* renders possible the input of an electrical control signal as the target value for the desired axial position of the drive piston 14. The target value is processed in the electronic regulation circuitry 26 and produces an electrical control signal for the valve means 27, which accordingly causes fluid actuation in the two working chamber 15 and 16.

Using external electrical lines 60 the power supply interface 53*a* may be connected with an electrical power source 48*b* and the control interface 53*b* with an electronic control means 48*c*.

The control interface 53*b* present, or an additional one, can be designed in the form of a bus interface so as to be able to connect a bus communicating with an external electronic control means 48*c*. By way of this bus control signals may then be supplied or furthermore feedback signals may be returned.

In order to find the current true value of the position of the drive piston 14 and accordingly of the output drive part 17 the drive device 1 is fitted with a position finding means 63. Same includes a rod-like measuring component 64 which is designed in the form of a component of the regulator cartridge 28 and starting at the terminal wall 12 extends into the drive space 8 axially. Preferably the measuring component 64 attached to the terminal wall 12 since it extends through the wall and is screwed in position detachably. By way of electrical conductors 65 the measuring component 64 is electrically linked within the accommodating space 25 with the electronic regulation circuitry 25.

In the working embodiment the measuring component 64 includes a linear potentiometer arranged in a guard tube 70 and having a slide 66 bridging over the printed wiring, such slide being coupled by magnetic force with the drive piston 14. In the working embodiment the latter bears a permanent magnet means 67 on its rear side facing the accommodating space 25, such means 67 ensuring that the slide 66 is always entrained so that a position signal is produced dependent on the linear position.

The rod-like measuring component 64 projects into the drive piston 14 and into the following output drive part 17 to a greater or lesser extent depending on the position. The drive piston 14 and the output drive part 17 are for this purpose at least partly hollow.

The position finding means 63 could also designed on a different functional principle. The essential function is the production of an electrical true value for the true position of the drive piston 14 or, respectively, of the output drive part 17, such true value being compared with the target value supplied from the outside in order to then on this basis to so activate the valve means 27 that the drive piston 14 is shifted into the desired target position.

Since the measuring component 64 is included in the regulator cartridge 28, it is installed jointly therewith or, respectively, deinstalled if necessary. During installation it is introduced into the space in the drive piston 14 of the output drive part 17.

In the interior of the closure cover 36 auxiliary electronic circuitry 62 is preferably installed connected with the electronic regulation circuitry, such circuitry 62 comprising at least one board possessing manually operated control elements 68 and optical display means 69. By way of the display means 69 it is possible for operationally relevant data to be displayed, as for example the target value and the true value of position regulation and/or the current operational mode, as for example a manual or an automatic mode of operation. The display means 69 comprise a more especially alphanumeric display.

The control elements 68 may for example be switches or keys, using which the operation of the device can be manually controlled and/or the operational parameters may be supplied and/or gotten by interrogation.

The auxiliary electronic circuitry 62 comprising preferably at least one board is in the working example accommodated, together with the control elements 68 and the display means 69, in a recess 72 in the cover, such recess being covered over by the cover board 73 in a sealing manner. The cover board 73 may be detached, more especially by loosening screws, which are not illustrated in detail, from the closure cover 36 and may in case of need have the fluid and/or electronic interfaces 52 and 53.

Opposite to the display means 69 the cover board 73 has a first window 74 sealed by transparent material so that the displayed information may be seen from the outside. A second window 75, placed opposite to the control elements 68, on the cover board 73 renders possible access to the control elements 68 and is shut off by a cover 76 in a sealing manner, such cover being readily able to be removed and being preferably screwed in place detachably. For the operation of the control elements 68 the cover 76 is temporally removed. The entire arrangement is so designed that rigorous sealing requirements are met.

To the extent that the position regulator 3 is to be controlled by an external bus, it will comprise suitable electronic bus circuitry. Such circuitry can be designed for processing different bus protocols. This electronic bus circuitry will be located like the other components of the position regulator 3 on board the regulator cartridge 28 and is for example a component of the auxiliary electronic circuitry 62.

The control of the servo-member 3 by an external electronic control means may also be wireless. For this purpose at least one suitably designed electrical interface will be present in the regulator module 28 and will more especially have electronic receiving and transmitting circuitry. This circuitry may include a webbrowser.

In the working embodiment a position related setting of the drive piston 14 takes place. However pressure-related setting or positioning of the drive piston would also be possible, the valve means 27 having in such a case preferably differential pressure proportional valve means for control of the two working chambers 15 and 16 and pressure sensors responsive to the pressures obtaining in the working chambers 15 and 16.

The invention claimed is:

1. A drive device comprising:

a fluid operated drive, which possesses a drive housing defining a drive space, in which at least one drive piston is located, said piston being able to be linearly set by fluid action and being kinematically coupled with an output drive part, a position regulator responsible for the positioning of the at least one drive piston and possessing electronic regulation circuitry and a valve means, such position regulator being a component of a regulator cartridge, which is inserted as a unitary assembly from the side, which is axially opposite the drive space, through an installation opening into an accommodating space defined by an integral extension of the drive housing made in one piece therewith and axially adjoining the drive space.

2. The drive device as set forth in claim 1, wherein the drive space and the accommodating space are arranged in axial sequence in the interior space of a tubular body of the drive housing made of one piece.

3. The drive device as set forth in claim 2, wherein the tubular body is an extruded part.

4. The drive device as set forth in claim 1, wherein the regulator cartridge is a plug member able to be inserted by an axial plugging movement into the accommodating space.

5. The drive device as set forth in claim 1, wherein the regulator cartridge inserted into the drive housing also constitutes a terminal wall delimiting the drive space on the side facing the accommodating space.

6. The drive device as set forth in claim 5, wherein the terminal wall is constituted by a disk body of the regulator cartridge peripherally provided with a seal.

7. The drive device as set forth in claim 5, wherein the regulator cartridge inserted in the drive housing also constitutes a closure cover closing the installation opening of the accommodating space.

8. The drive device as set forth in claim 7, wherein the closure cover cooperates with the drive housing to set the depth of insertion of the regulator cartridge.

9. The drive device as set forth in claim 7, wherein the terminal wall and the closure cover are combined by way of at least one distance piece to form a bearing structure bearing the electronic regulation circuitry and the valve means.

10. The drive device as set forth in claim 9, wherein several rod-like spaced apart distance pieces extend between the terminal wall and the closure cover.

11. The drive device as set forth in claim 9, wherein the electronic regulation circuitry and the valve means are arranged axially between the terminal wall and the closure cover.

12. The drive device as set forth in claim 1, wherein all fluid and electrical interfaces provided for fluid and electrical communication with external means are arranged at the regulator cartridge.

13. The drive device as set forth in claim 12, wherein the interfaces are arranged on or in a closure cover.

14. The drive device as set forth in claim 12, wherein the interfaces are accessible from the outer end side, facing away from the drive space, of the closure cover.

15. The drive device as set forth in claim 12, wherein the electrical interfaces comprise a power supply interface for the feed of the operating power and at least one control interface for control signals.

16. The drive device as set forth in claim 15, wherein at least one control interface is in the form of a bus interface.

17. The drive device as set forth in claim 1, wherein at least one electrical interface provided on the regulator cartridge is designed for wireless signal transmission.

18. The drive device as set forth in claim 7, wherein the closure cover, in particular at the end side facing away from the drive space, bears manually operated control elements and/or optical display means.

19. The drive device as set forth in claim 18, wherein in the interior of the closure cover auxiliary electronic circuitry is arranged associated with the control elements and/or the display means, such auxiliary electronic circuitry also being connected with the electronic regulation circuitry.

20. The drive device as set forth in claim 19, wherein the auxiliary electronic circuitry is accommodated in a recess, covered by a cover board, in the closure cover.

21. The drive device as set forth in claim 1, wherein a position finding means responsive to the piston's position, such position finding means being at least partly designed as a component of the regulator cartridge.

22. The drive device as set forth in claim 1, wherein the regulator cartridge possesses a measuring component of an electronic position finding means, such measuring component extending into the drive space and being responsive to the piston's position.

23. The drive device as set forth in claim 22, wherein the measuring component extends into the drive piston.

24. The drive device as set forth in claim 1, wherein the drive space is divided up by the at least one drive piston into two working chambers, the regulator cartridge having two fluid control ducts in fluid connection with the valve means, of which the one opens directly into the working chamber axially adjoining the regulator cartridge, whereas the other is so placed that it communicates, when the regulator cartridge is installed, with an internal fluid duct of the drive housing, such fluid duct leading to the other working chamber.

* * * * *